United States Patent [19]

Komatsu et al.

[11] Patent Number: 4,545,325

[45] Date of Patent: Oct. 8, 1985

[54] DEVELOPING APPARATUS

[75] Inventors: Isamu Komatsu, Takahagi; Masayasu Anzai, Hitachi; Nobuyoshi Hoshi, Katsuta; Susumu Akimaru, Hitachi, all of Japan

[73] Assignees: Hitachi, Ltd.; Hitachi Koki Co., Ltd., both of Tokyo, Japan

[21] Appl. No.: 523,859

[22] Filed: Aug. 17, 1983

[30] Foreign Application Priority Data

Aug. 23, 1982 [JP] Japan ..... 57-144700

[51] Int. Cl.[4] ..... G03G 15/01

[52] U.S. Cl. ..... 118/645; 118/652; 118/658

[58] Field of Search ..... 118/645, 652, 658

*Primary Examiner*—Bernard D. Pianalto

*Attorney, Agent, or Firm*—Antonelli, Terry & Wands

[57] ABSTRACT

Disclosed is a second toner developing apparatus for use in a two color electro-photographic recording apparatus in which a photosensitive drum is uniformly charged, subject to a first exposure, developed with a first toner, subject to a second exposure, and then developed with a second toner. The second developing apparatus is provided with a rotary sleeve for performing magnetic brush development and a fixed magnet disposed within the rotary sleeve. The fixed magnet includes a plurality of magnetic poles of the same polarity provided close to each other, so as to temporarily separate the second developer from the surface of the rotary sleeve at the position of these same polarity magnetic poles. An electrostatic attraction electrode attracts the first toner mixed in the thus separated second developer to thereby remove the first toner from the second developer.

10 Claims, 4 Drawing Figures

DEVELOPING APPARATUS

BACKGROUND OF THE INVENTION

1. Field of the Invention

The present invention relates to a developing apparatus and particularly to a developing apparatus provided with a function to separate and remove different colored toner mixed into a developer.

2. Description of the Prior Art

A two color electrophotographic recording apparatus has been proposed in which the surface of a photoconductive photosensitive recording medium is uniformly charged, then the first exposure is performed to discharge the region to which a first toner is to be attached to thereby form a first electrostatic latent image, then the first electrostatic latent image is subject to reversal development by the first developing apparatus to thereby form a first toner image, then the uniformly formed charge residual region is subject to the second exposure to form a second electrostatic latent image, and then the second electrostatic latent image is subject to reversal development to thereby form the second toner image. When the photoconductive photosensitive recording medium is the final one, the two toner images are fixed as they are on the recording medium. In the case where the photoconductive photosensitive recording medium is an intermediate one such as photosensitive drum which is repeatedly used, the two toner images are transferred onto a sheet of recording paper such as a sheet of plain paper and then fixed thereon.

In such a recording apparatus, the development of the second electrostatic latent image by using the second developing apparatus is performed to the recording medium surface at which the first toner is held by electrostatic force and therefore when the second developer of the second developing apparatus is applied onto the recording medium surface, a part of the toner constituting the first toner image is removed therefrom and mixed into the second developer. If the operation time of the recording apparatus is prolonged, the mixed toner is accumulated in the second developing apparatus. As the amount of the first toner mixed in the second developer increases, the second toner image becomes muddy so that clear two-color image can not be obtained. In order to prevent the turbidity of the second toner image, a developing apparatus has been proposed which is provided with a mixed toner removing means for removing the first toner mixed into the second developer. The mixed toner removing means is arranged such that by utilizing the difference in polarity of charge between the first toner and the second toner in the second developer, an electrostatic attraction roll applied with a voltage of the same polarity as the second toner (that is the different polarity from the first toner) is employed to attract the first toner mixed in the second developer to thereby remove the first toner from the second developer. In the case where the first toner in the first developing apparatus is charged with the same polarity as the second toner in the second developing apparatus, it is arranged such that the charge polarity of the first toner is reversed when it is mixed into the second developer.

Since the developer moves in the developing apparatus in the form of layer flow, it is impossible to cause the electrostatic attraction force to effectively act on the first toner mixed into the inside of the layer of the second developer and therefore the mixed toner can not be sufficiently removed.

SUMMARY OF THE INVENTION

An object of the invention is, therefore, to provide a developing apparatus provided with a mixed toner removing means for effectively removing the first toner mixed into the second developer.

To attain this object, according to an aspect of the present invention, the developing apparatus comprises a non-magnetic rotary sleeve, a magnet means fixedly provided in the rotary sleeve to attract a developer to the outer periphery of the rotary sleeve, and an electrostatic attraction electrode provided in opposite to the outer periphery of the rotary sleeve, the magnet means having a plurality of magnetic poles of the same polarity closely provided with each other at the position opposed to the electrostatic attraction electrode. Thus, the second developer transported along the outer periphery of the rotary sleeve is temporarily set free from the outer periphery of the rotary sleeve and scattered above the position of the above-mentioned magnetic poles, so that the electrostatic attraction force of the electrostatic electrode effectively acts on the mixed first toner to thereby improve the mixed toner removal efficiency.

In the case where both the first and second electrostatic latent images formed on the recording medium are negative ones (that is, the charges in the region to which toner is to be attached have been obviated), each of the first and second toner in the first and second developing apparatuses respectively is provided with a reversal developing characteristic in the charged state of the same polarity as the electrostatic latent image. This is attained by selecting the charging characteristic due to friction between the toner and the carrier or other frictional charging member. In this case, accordingly, it is necessary to select the material of the first toner such that the first toner has a frictional charging characteristic that the charge polarity of the first toner is reversed by the charging due to friction between the first toner and the second toner or carrier in the second developer or other frictional charging member. On the contrary, in the case where the first electrostatic latent image is a negative one and the first developer has a reversal developing characteristic, while the second electrostatic latent image is a positive one (that is, the charges in the region to which toner is not to be attached have been obviated) and the second developer has a normal developing characteristic, the first toner in the first developer and the second toner in the second developer are charged in different polarity from each other. In this case, since the first toner mixed into the second developer is different in polarity from the second toner from the beginning, it is necessary to select the material of the first toner such that the first toner has a frictional charging characteristic that the first toner may maintain its charging characteristic.

DESCRIPTION OF THE PREFERRED EMBODIMENTS

Figure 1:
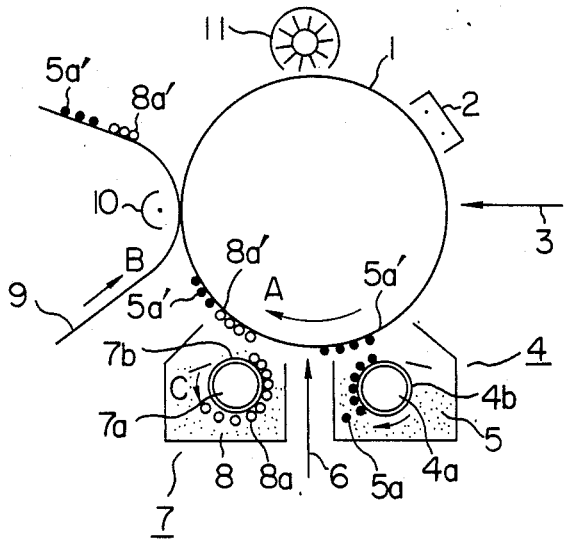
FIG. 1 is a schematic diagram illustrating the configuration of the two color electrophotographic recording apparatus to which the developing apparatus according to the present invention is applied.

FIG. 1 is a schematic diagram illustrating the configuration of the two color electrophotographic recording apparatus to which the developing apparatus according to the present invention is applied. In FIG. 1, a photoconductive photosensitive drum 1 is driven at a constant speed in the direction of the arrow (A) so that the surface of the same is uniformly charged, for example, at positive polarity by a corona charger 2. The uniformly charged surface of the photoconductive photosensitive drum 1 is exposed by the first picture image light, such as a laser beam 3, to form the first electrostatic latent image thereon and the first electrostatic latent image is developed by the first developer 5 in the first developing apparatus 4. The first developing apparatus 4 has a reversal developing characteristic and the first developer 5 is composed of the first toner 5*a* (shown in exaggeration) charged at positive polarity and magnetic carrier (not-shown). The first developer 5 is attracted to the surface of a developing roller constituted by a fixed magnetic roll 4*a* and a non-magnetic rotary sleeve 4*b* to thereby form a magnetic brush for lightly rubbing against the surface of the photoconductive photosensitive drum 1. Owing to the reversal development by the magnetic brush, the first toner image 5*a*′ attracted by the first electrostatic latent image is formed on the surface of the photoconductive photosensitive drum 1. Thereafter, the nonexposed region of the photoconductive photosensitive drum 1 is exposed by the second picture image light, such as a laser beam 6, to thereby form a negative, second electostatic latent image which is then developed by a second developer 8 in the second developing apparatus 7. The second developing apparatus 7 also has a reversal developing characteristic and the second developer 8 is composed of second toner 8*a* (shown in exaggeration) charged at positive polarity and magnetic carrier (not-shown). The second developer 8 is also attracted to the surface of a developing roller constituted by a fixed magnetic roll 7*a* and a non-magnetic rotary sleeve 7*b* to thereby form a magnetic brush for lightly rubbing against the surface of the photoconductive photosensitive drum 1. The present invention is applied to the second developing apparatus 7 and the details will be described later. Upon the development by this second developing apparatus, the second toner image 8*a*′ attracted by the second electrostatic latent image is formed on the surface of the photoconductive photosensitive drum 1. The first and second toner images 5*a*′ and 8*a*′ formed on the surface of the photonconductive photosensitive drum 1 in the abovementioned manner are transferred by a transfer device (corona charger) 10 onto a sheet of ordinary recording paper 9 which is conveyed in the direction of the arrow (B). Upon the completion of transfer, the surface of the photoconductive photosensitive drum 1 is cleared by a cleaner 11 to terminate a series of electrophotographic processes and then the next series of electrophotographic processes is initiated. In this recording apparatus, the first and second toner 5*a* and 8*a* may by made different in color from each other so as to obtain two color toner images 5*a*′ and 8*a*′ on the ordinary recording paper 9.

Figure 2:
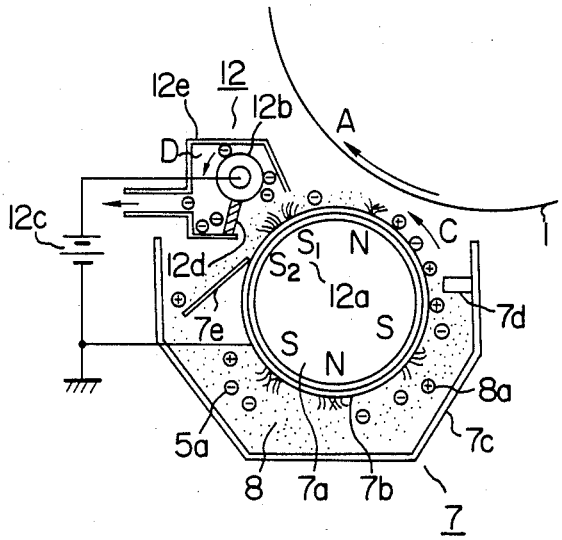
FIG. 2 is a cross-section of the developing apparatus according to an embodiment of the present invention.

Referring to FIG. 2, the second developing apparatus 7 according to an embodiment of the present invention will be next described.

The second developer 8, which is a mixture of the second toner 8*a* and the carrier, is contained in the bottom portion of a developer container 7*c* of the second developing apparatus 7. The second developer 8 attracted in layers onto the outer periphery of the non-magnetic rotary sleeve 7*b* by the magnetic force of the fixed magnetic roll 7*a* is conveyed in the circumferential direction since the non-magnetic rotary sleeve 7*b* rotates in the direction of the arrow (C). A doctor blade 7*d* restricts the thickness of the layer or magnetic brush of the developer 8 formed on the non-magnetic rotary sleeve 7*b* to a predetermined value so as to limit the force of the magnetic brush exerted on the surface of the photoconductive photosensitive drum 1. After the magnetic brush formed onto the outer periphery of the non-magnetic rotary sleeve 7*b* has developed the second electrostatic latent image formed on the surface of the photoconductive photosensitive drum 1, it is scraped by a scraper 7*e* and dropped into the bottom portion of the developer container 7*c*. Being circulated in this manner, the second developer 8 is agitated so that the second toner 8*a* is charged at positive polarity by friction. A mixed toner removal means 12 is arranged as follows in combination with the second developing apparatus 7. On the outer periphery of the fixed magnetic roll 7*a* of the second developing roller, a plurality of magnetic poles 12*a* of the same polarity are formed closely with each other. The second developer 8 is transported to these magnetic poles 12*a* by the non-magnetic rotary sleeve 7*b* and then temporarily set free from the outer periphery of the non-magnetic rotary sleeve 7*b* to be scattered by the transport force of the non-magnetic rotary sleeve 7*b* and the repulsive force of the plural magnetic poles 12*a*. An electrostatic attraction roller 12*b* is provided in the position opposed to the magnetic poles 12*a* so that an electrostatic attraction field is exerted on the scattered second developer 8. An electric source 12*c* is connected to the non-magnetic rotary sleeve 7*b* and the electrostatic attraction roller 12*b* so as to supply the electrostatic attraction roller 12*b* with a potential of the same polarity as the second toner 8*a*. A scraper 12*d* is provided for scraping the toner electrostatically attracted to the surface of the electrostatic attraction roller 12*b*. An air suction casing 12*e* is open in the region where the toner separated and flying up from the carrier of the second developer 8 and/or the toner scraped from the electrostatic attraction roller 12*b* exits. The air suction causing is provided for sucking the toner to thereby remove it from the removal means 12. The electrostatic attraction roller 12*b* is constituted by a conductive substrate the surface of which has been subject to insulating processing and caused to rotate in the direction of the arrow (D).

When the photoconductive photosensitive drum 1 is developed by the second developer 8, the second toner 8*a* is attached to the surface of the photoconductive photosensitive drum 1 and at the same time a part of the first toner 5*a* previously attached to the surface of the photoconductive photosensitive drum 1 is scraped therefrom to be mixed into the magnetic brush (the second developer 8) of the second developing apparatus 7. The second developer 8 and the mixed first toner 5*a* in the second developing apparatus 7 are agitated in the process during which they are transported by the surface of the non-magnetic rotary sleeve 7*b*, in the process during which they are scraped and dropped from the non-magnetic rotary sleeve 7b by the scraper 7e, and in the bottom portion of the developer container 7c. Due to the agitation, the amount of charges of the first toner 5a is reduced near to zero or the charge polarity is reversed by the above-mentioned frictional charging characteristic. The second developer 8 containing the first toner 5a, the charge amount or the charge polarity of which has been changed, is erected in the form of chains on each of the magnetic poles $S_1$ and $S_2$ when it reaches the position of the plurality of magnetic poles 12a of the same polarity in the process during which it is transported again by the surface of the non-magnetic rotary sleeve 7b. Since the respective erection regions are magnetized in the same polarity and strongly repulse each other in the vicinity of the surface of the non-magnetic rotary sleeve 7b, the flow of the developer 8 is blocked and heaped up above the magnetic pole $S_1$ so that the forward end portion is pushed over and scattered. Since the scattered developer 8 is demagnetized, it is attracted to the non-magnetic rotary sleeve 7b again by the magnetic force of the magnetic pole $S_2$. When the developer 8 becomes in the scattered state in this manner above the magnetic poles 12A, the mixed toner 5a the charge polarity of which is reversed to be the same as the carrier, the mixed toner 5a the charge amount of which is reduced to nearly zero, and the toner 8a the charge amount of which is reduced because of the deterioration in characteristic, are separated from the carrier. Accordingly, the electrostatic attraction force by the electrostatic attraction roller 12b is effectively exerted onto the mixed toner 5a to attract the same. The toner 5a attracted to the electrostatic attraction roller 12b is scraped by the scraper 12d and thereafter suction-removed. A withdrawal receptacle may be provided under the scraper 12d so as to withdraw the toner by removing the withdrawal receptacle. Although it is difficult to remove the toner 5a and 8a the charge amount of which becomes nearly zero by the electrostatic attraction force, it can be suction-removed by the sucking air because the air sucking casing 12e is open in the scattering region of the developer 8.

In the developing apparatus 7, it is not necessary to integrate the attraction and sucking mechanism of the mixed toner removal means 12 with the developing mechanism constituted by the developer container 7c and the developing roll, etc., and therefore in the case where it is desired to change the second color, it is preferable to arrange only the developing mechanism to be removable or replacable to facilitate the changing-over operation of the developing mechanism.

Figure 3:
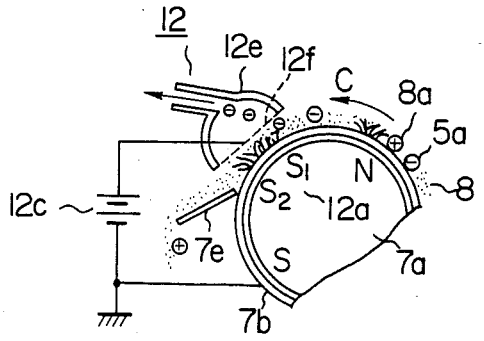
FIG. 3 is a cross-section of a main part of the developing apparatus according to another embodiment of the present invention.

FIG. 3 shows another embodiment of the second developing apparatus of FIG. 2. In this embodiment, the electrostatic attraction roller 12b in the developing apparatus of FIG. 2 is replaced by a porous electrode 12f made of a porous material such as a wire netting and the other structure is quite the same as that of FIG. 2 embodiment, the illustration thereof being therefore eliminated in FIG. 3. In this developing apparatus, the electrostatic attraction force of the porous electrode 12f acts on the developer 8 in the scattered state so that the first toner 5a, the charge polarity of which is reversed, is attracted to the porous electrode 12f. The first toner 5a attracted to the porous electrode 12f is removed by the suction air flow. Since this air flow acts on the toner scattering/agitation region, the toner the charge amount of which has become nearly zero, is also suction-removed by this suction air flow. Further, since the porous electrode 12f of this embodiment is not rotated, the arrangement is simplified.

Figure 4:
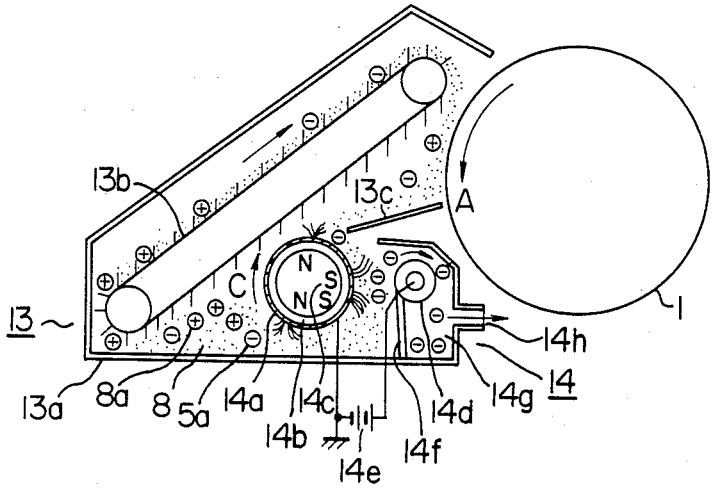
FIG. 4 is a cross-section of the developing apparatus according to a further embodiment of the present invention.

Referring to FIG. 4, a case is illustrated where the present invention is applied to a developing apparatus 13 of the cascade developing system. In the developing apparatus 13, the second developer 8 contained in the bottom portion of a developer container 13a is transported by a bucket conveyor 13b and cascaded over a photoconductive photosensitive drum 1 so as to develop a second electrostatic latent image. The developer 8 after developing is received by a guide plate 13c and guided to the surface of a non-magnetic electrically-conductive rotary sleeve 14a constituting a mixed toner removal means 14. A fixed magnetic roll 14b is disposed within the non-magnetic sleeve 14a so that the second developer 8 is transported in the piled-up state in layers on the surface of the non-magnetic rotary sleeve by the magnetic force of the fixed magnetic roll 14b. A plurality of magnetic poles 14c of the same polarity are disposed closely to each other on the outer periphery of the fixed magnetic roll 14b so that the developer 8 is scattered and agitated similarly to the previously described embodiment. The electrostatic attraction roller 14d is disposed at a position opposed to the magnetic poles 14c so that an electrostatic attraction field may act on the scattering/agitation region. An electric source 14e is connected to the electrostatic attraction roller 14d so that the electrostatic attraction roller 14d is supplied with a voltage of the same polarity as the second toner 8a. A partition 14f forms a toner withdrawal receptacle 14g at a side of the developer container 13a and the forward end of the partition 14f is in contact with the electrostatic attraction roller 14d to form a scraper member. The toner withdrawal receptacle 14g is opened in the vicinity of the above-mentioned scattering/agitation region of the developer 8 and communicated with an air suction pipe 14h so as to have the same function as the air suction casing in the previous embodiment.

Also in the developing apparatus 13 of this embodiment, accordingly, the mixed first toner 5a and the decayed second toner 8a are removed in the same manner as in the previous embodiment.

In the above-mentioned embodiments, although the description has been made with respect to the case where a two-component developer composed of toner particles and carrier particles is used for each of the developers 5 and 8, the same effect can be obtained even in the case where a one-component developer in which toner and carrier are integrated is employed.

In the above-mentioned embodiments, the unnecessary toner removal efficiency can be improved by providing an agitation bar in the flying region of the scattered and agitated developer so as to prevent the developer from flying.

As described above, according to the present invention, the second developer transported along the outer periphery of a rotary sleeve is scattered and agitated by a plurality of the same polarity magnetic poles disposed closely to each other and electrostatic attraction force is caused to exert on the scattering/agitation region, resulting in an advantage that the mixed toner can be efficiently removed.

We claim:

1. A developing apparatus for developing, by a second toner of a second developer, a second electrostatic latent image formed on a recording medium carrying a first toner image formed by a first toner attracted to a first electrostatic latent image on said recording medium, said apparatus comprising second developing means for developing with said second toner of said second developer said second electrostatic latent image formed on said recording medium, said second developing means including a developer container for accommodating said second developer and means for carrying said second developer in said developer container to said recording medium to develop said second electrostatic latent image on said recording medium; and mixed toner removal means for removing first toner, which is mixed in the second developer including the second toner and which is charged in the polarity different from the second toner, said removal means including an electrostatic attraction electrode which is supplied with a voltage of the same polarity as the second toner, to thereby remove the first toner from the second developer, and a non-magnetic rotary sleeve disposed in opposition to said electrostatic attraction electrode, magnet means being provided at the inside of said rotary sleeve so as to attract the second developer to the outer periphery of said rotary sleeve, said magnet means being provided with a plurality of magnetic poles of the same polarity formed closely to each other at a position opposed to said electrostatic attraction electrode.

2. A developing apparatus according to claim 1, in which said rotary sleeve constitutes a developer roller which serves as said means for carrying the second developer attracted to the surface of said rotary sleeve to develop said second electrostatic latent image on the surface of said recording medium.

3. A developing apparatus according to claim 1, in which said electrostatic attraction electrode is in the form of a roll, and wherein a scraper member is provided for scraping the toner attracted to the periphery of said electrostatic attraction electrode, and air sucking means are provided for sucking the toner scraped by said scraper member.

4. A developing apparatus acording to claim 2, in which said mixed toner removal means includes said electrostatic attraction electrode in the form of a roll, a scraper member for scraping the toner attracted to the periphery of said electrostatic attraction electrode, and air sucking means for sucking the toner scraped by said scraper member.

5. A developing apparatus according to claim 3, in which said air sucking means includes an air sucking casing having an opening opposed to said rotary sleeve at the position of said plurality of the same polarity closely provided magnetic poles, said electrostatic attraction electrode and said scraper member being contained in said air sucking casing.

6. A developing apparatus according to claim 4, in which said air sucking means includes an air sucking casing having an opening opposed to said rotary sleeve at the position of said plurality of the same polarity closely provided magnetic poles, said electrostatic attraction electrode and said scraper member being contained in said air sucking casing.

7. A developing apparatus according to claim 1, in which said electrostatic attraction electrode is made of a porous material, and air sucking means are provided for sucking the toner attracted to said porous electrostatic attraction electrode to thereby remove the first toner from the second developer.

8. A developing apparatus according to claim 2, in which said electrostatic attraction electrode is made of a porous material, and air sucking means are provided for sucking the toner attracted to said porous electrostatic attraction electrode to thereby remove the first toner from the second developer.

9. A developing apparatus according to claim 7, in which said air sucking means includes an air sucking casing having an opening opposed to said rotary sleeve at the position of said plurality of the same polarity closely provided magnetic poles, said porous electrostatic attraction electrode being provided at said opening of said air sucking casing.

10. A developing apparatus according to claim 8, in which said air sucking means includes an air sucking casing having an opening opposed to said rotary sleeve at the position of said plurality of the same polarity closely provided magnetic poles, said porous electrostatic attraction electrode being provided at said opening of said air sucking casing.

* * * * *